US007978141B2

(12) United States Patent
Chi et al.

(10) Patent No.: US 7,978,141 B2
(45) Date of Patent: Jul. 12, 2011

(54) COUPLE-FED MULTI-BAND LOOP ANTENNA

(75) Inventors: Yun-Wen Chi, Sinjhuang (TW); Kin-Lu Wong, Kaohsiung (TW)

(73) Assignee: Acer Incorporated, Taipei Hsien (TW)

( * ) Notice: Subject to any disclaimer, the term of this patent is extended or adjusted under 35 U.S.C. 154(b) by 363 days.

(21) Appl. No.: 12/286,254

(22) Filed: Sep. 29, 2008

(65) Prior Publication Data

US 2009/0273530 A1 Nov. 5, 2009

(30) Foreign Application Priority Data

May 5, 2008 (TW) ..... 97116537 A

(51) Int. Cl.
*H01Q 11/12* (2006.01)
*H01Q 1/38* (2006.01)

(52) U.S. Cl. ..... 343/741; 343/700 MS; 343/850; 343/860

(58) Field of Classification Search ..... None
See application file for complete search history.

(56) References Cited

U.S. PATENT DOCUMENTS

| | | | | |
|---|---|---|---|---|
| 5,861,854 | A * | 1/1999 | Kawahata et al. | 343/702 |
| 6,800,832 | B2 * | 10/2004 | Hutchison et al. | 219/130.21 |
| 6,903,690 | B2 * | 6/2005 | Leclerc et al. | 343/700 MS |
| 6,903,691 | B2 * | 6/2005 | Sato et al. | 343/700 MS |
| 7,196,667 | B2 * | 3/2007 | Watada et al. | 343/700 MS |
| 7,265,726 | B2 | 9/2007 | Kenoun et al. | |
| 2002/0118075 | A1 * | 8/2002 | Ohwada et al. | 333/32 |
| 2007/0268191 | A1 | 11/2007 | Ishizuka et al. | |

FOREIGN PATENT DOCUMENTS

| | | |
|---|---|---|
| EP | 0 814 535 A2 | 12/1997 |
| EP | 1 154 516 A1 | 11/2001 |
| FR | 2 860 927 A1 | 4/2005 |
| JP | 10-173425 A | 6/1998 |

* cited by examiner

*Primary Examiner* — Trinh V Dinh
(74) *Attorney, Agent, or Firm* — Hudak, Shunk & Farine Co. LPA

(57) ABSTRACT

The present invention is related to a coupled-fed multi-band loop antenna. The antenna comprises a dielectric substrate, a ground plane located on the dielectric substrate and has a grounding point, a radiating portion which comprise a supporter, a coupling trip and a loop strip, and a matching circuit. The coupling strip and loop strip are both located on the supporter, with the coupling strip surrounded by the loop strip. The length of loop strip is about 0.25 wavelength of the antenna's first resonant mode. The loop strip has a first end paralleling with the coupling loop, a second end and a shorting point near the second end and electrically connected to the grounding point on the ground plane. The matching circuit is on the dielectric substrate. One terminal of the matching circuit is connected to the coupling strip, and the other is connected to a signal source.

7 Claims, 10 Drawing Sheets

COUPLE-FED MULTI-BAND LOOP ANTENNA

RELATED APPLICATIONS

This application claims a priority under 35 U.S.C. 119 to Application TAWAIN 097116537, filed on May 5, 2008, the disclosures of which Applications are incorporated by reference herein.

FIELD OF THE INVENTION

The present invention is related to a loop antenna, particularly to a coupled-fed multi-band loop antenna which is suitable to be installed in mobile communication devices.

BACKGROUND OF THE INVENTION

With the rapid development of wireless communication, all wireless communication products are made light, thin, short and small in appearance in trend and in fashion so as to cater to the demand of consumers market. Meanwhile, the wireless communication product is required to provide various services; it means that more and more system modules and elements will be installed in the limited space of the wireless communication product. Hence, the space for installing the antenna will be compressed significantly.

Because the conventional monopole antenna and PIFA (planar inverted-F antenna) antenna usually require wide metal strips to achieve the required wide bandwidths for practical applications, the loop antenna with a narrow strip width becomes an attractive choice for the demand for smaller and multi-band antenna. For example, a loop antenna with multiple metal arms is disclosed in U.S. Pat. No. 7,265,726 B2 "Multi-band antenna", and used in GSM, DSC, and UMTS mobile communication system as an internal mobile phone antenna for multi-band operation. Though a narrow metal strip is used for the loop antenna, the required wide bandwidth can be obtained. But in this former case, half-wavelength mode and one-wavelength mode of the conventional loop antenna are used. The half-wavelength mode is provided for GSM operation, which makes the antenna size difficult to be reduced. On the other hand, according to "Antenna and wireless communication devices" disclosed in No. US 20070268191 A1, the multi-band operation can also be achieved by using a matching circuit. Here, a new design of a coupled-fed multi-band loop antenna is disclosed. This design is different from the conventional loop antenna used in the mobile phone, which uses the half-wavelength loop mode as its first resonant mode. The antenna of the present invention uses the quarter-wavelength mode of the loop antenna as its first resonant mode. In this case, for application in the same operating band, the size of the antenna can be reduced by half. Compared with the conventional design of the internal mobile phone antenna, the design of the present invention is capable of saving more antenna occupied space to accommodate other associated elements, such as the loudspeaker or camera lens, and so on. The antenna of the present invention is designed in a manner of using a coupling feed, so that the quarter-wavelength mode of the loop antenna can be excited successfully with good impedance matching. Thus, the size of the antenna of the invention is only half of the conventional loop antenna. Besides, a matching component group can further be used to compensate for the large imaginary part of the half-wavelength and one-wavelength resonant modes of the loop antenna, so that these two modes can also have good impedance matching, thereby the antenna can cover four operating bands of GSM/DCS/PCS/UMTS and satisfy the demand for wireless communications.

SUMMARY OF THE INVENTION

Therefore, one of the objectives of the present invention is to provide a loop antenna for the mobile phone, capable of covering GSM (890~960 MHz)/DCS (1710~1880 MHz)/PCS (1850~1990 MHz)/UMTS (1920~2170 MHz) operations for the mobile phone, and the size of the antenna of the present invention is only half of the conventional mobile phone antenna operating at the same frequency band. Besides, such an antenna has the advantages of simple structure, clear operating mechanism, easy fabrication, and saving of the inner space of the mobile phone.

The antenna of the present invention comprises a dielectric substrate, a ground plane, a radiating portion and a matching component group. The ground plane is located on the dielectric substrate and has a grounding point. The radiating portion comprises a supporting substrate, a coupling metal strip and a radiating loop-shaped metal strip. The coupling metal strip of the radiating portion is located on the supporting substrate of the radiating portion, and the radiating loop-shaped metal strip is also located on the supporting substrate and encloses the coupling metal strip. The length of the radiating loop-shaped metal strip is substantially ¼ wavelength of the lowest resonant frequency of the antenna. The radiating loop-shaped metal strip has a first end, a second end and a shorting point; the first end is roughly parallel with the coupling metal strip, and the shorting point is located near the second end and electrically connected to the grounding point of the ground plane. The matching component group is located on the dielectric substrate. One terminal of the matching component group is electrically connected to the coupling metal strip of the radiating portion, and the other terminal is connected to a signal source through a signal line.

Preferably, the dielectric substrate is a system circuit board of the mobile communication device.

Preferably, the ground plane is a system ground plane of the mobile communication device.

Preferably, the ground plane is formed on the dielectric substrate by printing or etching.

Preferably, the material of supporting substrate is selected from the group consisting of the dielectric substrate, plastic and ceramics.

Preferably, the coupling metal strip of the radiating portion is substantially straight, L-shaped or T-shaped.

Preferably, the coupling metal strip has at least two arms.

Preferably, the matching component group is a circuit including at least one inductive component.

In the antenna of the present invention, the coupling feed is used to excite the ¼-wavelength resonant mode of the radiating loop-shaped metal strip, so that a lower band with good impedance matching can be formed. The ½-wavelength and one-wavelength resonant modes of the radiating loop-shaped metal strip are combined to form a wide operating band, and the matching component group is used to compensate for the large imaginary part of these two modes, and thereby an upper band with good impedance matching can be formed. The lower band, which is ¼-wavelength resonant mode, provides an operating bandwidth of about 100 MHz (890~990 MHz), which covers GSM operation. The return loss of this antenna in this required band is better than 6 dB. The upper band, which is formed by the ½-wavelength and one-wavelength resonant modes, provides an operating bandwidth of 500 MHz (1700~2200 MHz), which can cover DCS/PCS/UMTS operation. The return loss in this required band ranging from 1710~2170 MHz is better than 6 dB, and this can satisfy the communication application requirement. Meanwhile, the antenna of the present invention not only has a simple structure and a clear operating mechanism, but also shows a significantly reduced size when compared with the conventional mobile phone antenna operating at the same frequency band. This means the antenna of the present invention requires a much smaller volume inside the mobile phone. Therefore, the present invention has value of industrial application.

BRIEF DESCRIPTION OF THE DRAWINGS

The subject matter regarded as the invention is particularly pointed out and distinctly claimed in the concluding portion of the specification. The invention together with features and advantages thereof may best be understood by reference to the following detailed description with the accompanying drawings in which:

FIG. 6(*b*) is an antenna gain drawing of the first embodiment of the antenna of the present invention in the DCS/PCS/UMTS band;

DETAILED DESCRIPTION OF THE PREFERRED EMBODIMENTS

Exemplary embodiments of the present invention are described herein in the context of a coupled-fed multi-band loop antenna.

Those of ordinary skilled in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

Figure 1:
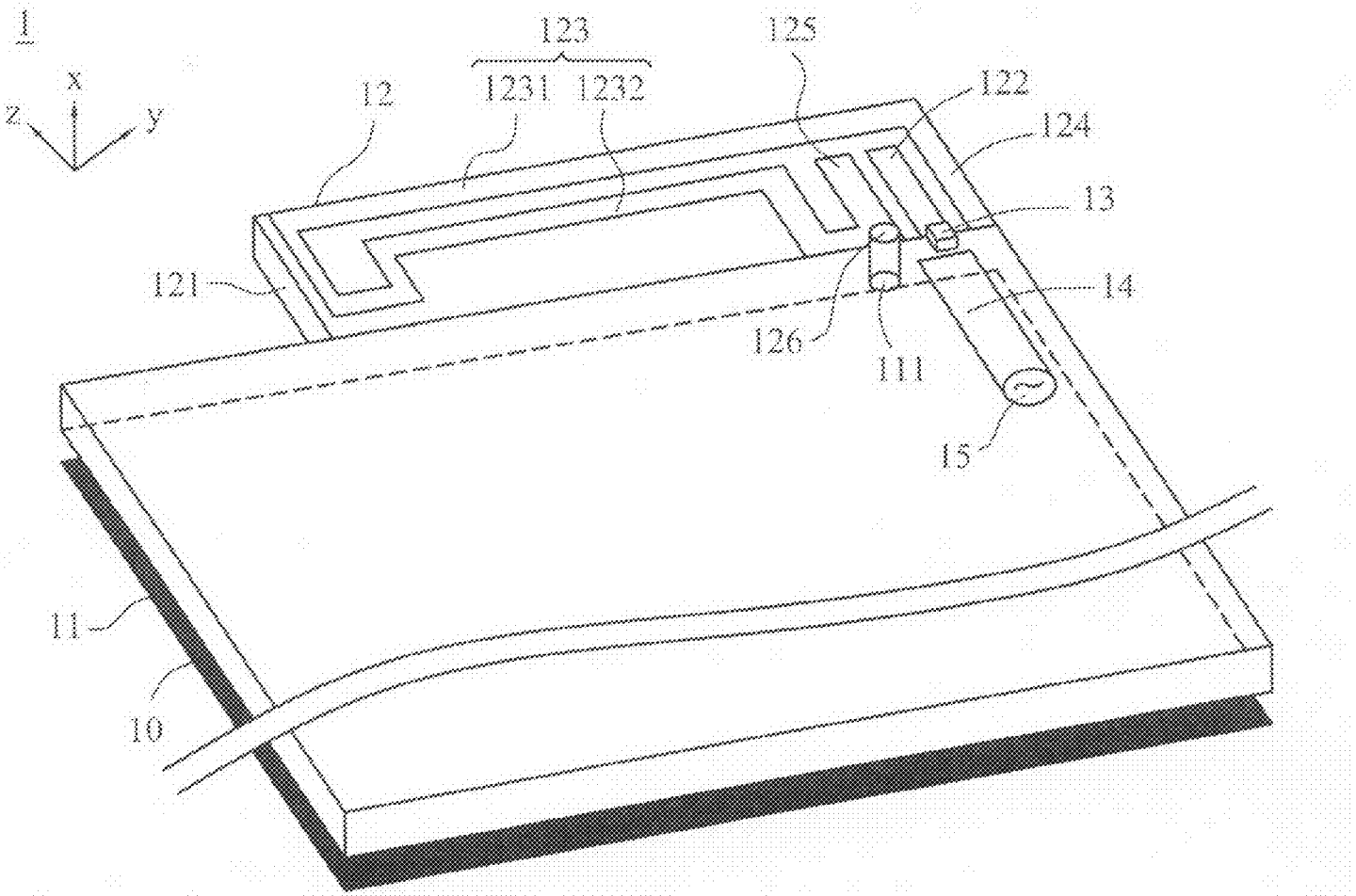
FIG. 1 is a structural drawing of the first embodiment of the antenna in the present invention.

FIG. 1 illustrates a structural drawing of the first embodiment of the antenna in the present invention. Embodiment 1 comprises a dielectric substrate 10, a ground plane 11, a radiating portion 12 and a matching component group 13. The ground plane 11 is located on the dielectric substrate 10, and has a grounding point 111. The radiating portion 12 comprises a supporting substrate 121, a coupling metal strip 122 and a radiating loop-shaped metal strip 123. The coupling metal strip 122 of the radiating portion 12 is located on the supporting substrate 121 of the radiating portion 12, and the radiating loop-shaped metal strip 123 is also located on the supporting substrate 121, and surrounds the coupling metal strip 122.

The length of the radiating loop-shaped metal strip 123 is roughly ¼-wavelength of the lowest resonant frequency of the antenna, and the radiating loop-shaped metal strip 123 has a first section 1231, a second section 1232, a first end portion 124, a second end portion 125, and a shorting point 126. The first end portion 124 is parallel with the coupling metal strip 122. The shorting point 126 is located near the second end portion 125 and electrically connected to the grounding point 111 of the ground plane 11. The matching component group 13 is located on the dielectric substrate 10. One terminal of the matching component group 13 is electrically connected to the coupling metal strip 122 of radiating portion 12, and the other terminal is connected to a signal source 15 through a signal line 14. An end of the second end portion 124 is connected to the shorting point 126, and the other end of the second end portion 124 is a free end. The coupling metal strip 122 is located between the first end portion 124 and the second end portion 125. The first section 1231 is connected to the first end portion 124 and extending perpendicular to the coupling metal strip 122, and the second section 1232 is parallel to the first section 1231.

Preferably, the dielectric substrate 10 is a system circuit board of a mobile communication device. Preferably, the ground plane 11 is a system ground plane of a mobile communication device. Preferably, the ground plane 11 is formed on the dielectric substrate 10 by printing or etching. Preferably, the material of the supporting substrate 131 of the radiating portion 12 is selected from the group consisting of a dielectric substrate, a plastic and ceramics. Preferably, the coupling metal strip 122 of the radiating portion 12 is substantially straight, or L-shaped or T-shaped. Preferably, the matching component group 13 is a circuit including at least one inductive component.

Figure 2:
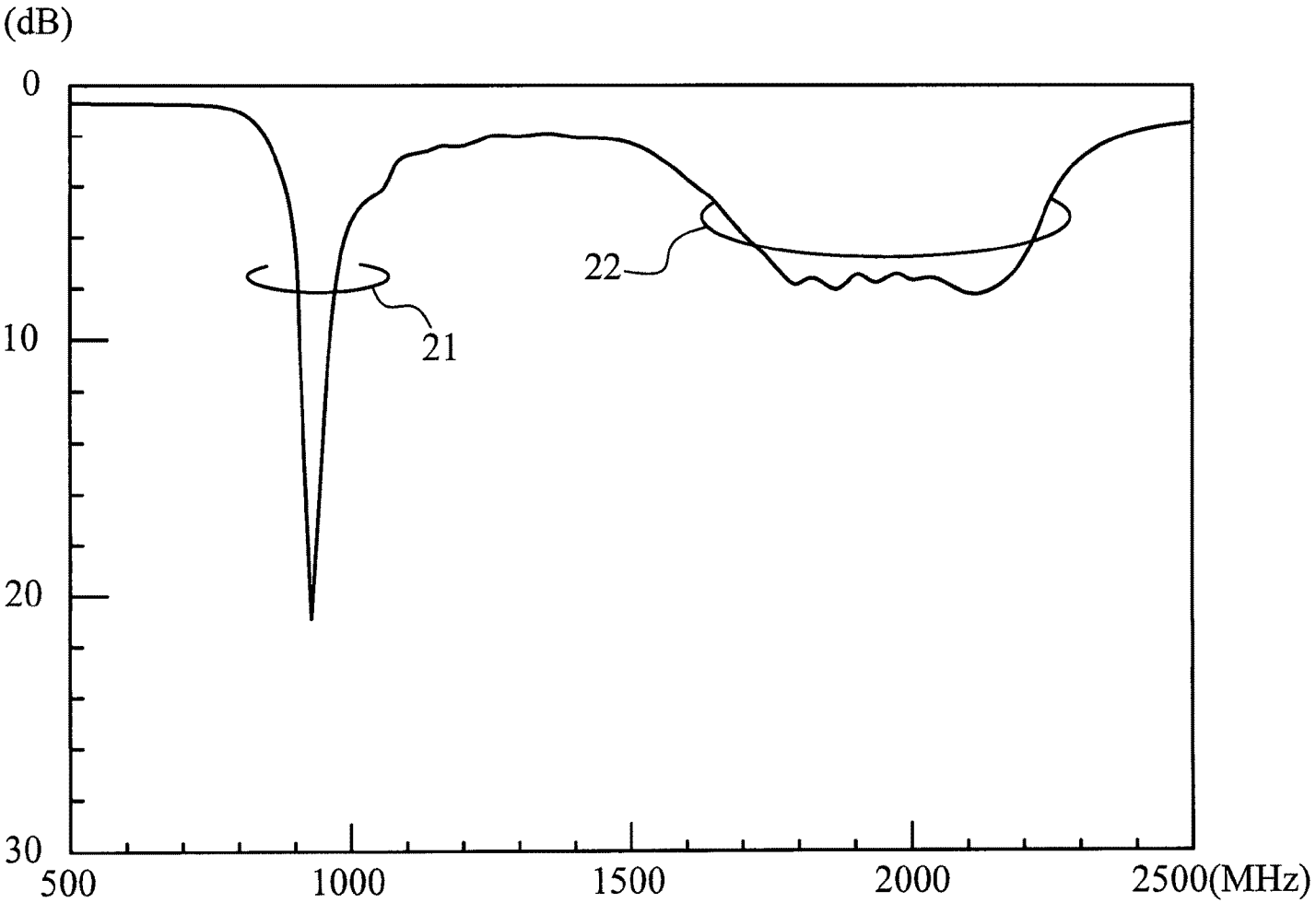
FIG. 2 is a measured result of return loss of the first embodiment of the antenna in the present invention.

FIG. 2 illustrates a measured result of return loss of first embodiment shown in FIG. 1. The following dimensions and values of the elements are selected to perform the experiment. The dielectric substrate 10 is an FR4 glass fiber substrate with thickness of 0.8 mm. The size of the ground plane 11 is 40*100 $mm^2$, and is etched on the surface of the dielectric substrate 11. The supporting substrate 121 of the radiating portion 12 is an FR4 glass fiber substrate with thickness of 0.8 mm. The length and width of the supporting substrate 121 is respectively 26 mm and 10 mm. Both the coupling metal strip 122 and the radiating ring-shaped metal strip 123 are printed on the surface of supporting substrate 131. The width of the coupling metal strip 122 shaped in a straight line is 1.5 mm and the length of which is 8.5 mm. Meanwhile, the length of the radiating loop-shaped metal strip 123 is 82 mm, and its length is about ¼ wavelength of the lowest resonant frequency. The radiating loop-shaped metal strip 123 has a first end 124, a second end 125 and a shorting point 126. The first end 124 is about 8.5 mm and substantially parallel with the coupling metal strip 122, and a series capacitive effect is formed between the first end 124 and the coupling metal strip 122.

The shorting point 126 is located near the second end 125 and electrically connected to the grounding point 111 of ground plane 11. The matching component group 13 is located on the dielectric substrate 10. One terminal of the matching component group 13 is electrically connected to the coupling metal strip 122 of the radiating portion 12. The other terminal is connected to a signal source 15 through a signal line 14. In first embodiment, the matching component group 1 is a circuit including an inductive component of 10 nH.

The antenna of the present invention is different from the conventional loop antenna which uses the ½ wavelength mode of the radiating loop-shaped metal strip as its first resonant mode to provide the required GSM operation. The length of radiating loop-shaped metal strip 123 adopted in the antenna of the present invention is 82 mm, which is just ¼ wavelength at 900 MHz. Therefore, the lower band 21 is the ¼-wavelength resonant mode of the radiating loop-shaped metal strip 123, and the upper band mode 22 is formed by the ½-wavelength resonant mode and one-wavelength resonant mode of the radiating loop-shaped metal strip 123. When the coupling metal strip 122 and the matching component group 13 are not used, this means that the first end 124 of the radiating ring-shaped metal strip 123 is directly connected to a signal source 15, only the ½-wavelength resonant mode of the loop antenna can be excited. When the coupling metal strip 122 is used, it is equivalent to serially connect a capacitor between the signal source 15 and the radiating loop-shaped metal strip 123. The serially connected capacitor is capable of compensating for high inductive impedance of the ¼-wavelength resonant mode of the radiating loop-shaped metal strip 123, so that the ¼-wavelength resonant mode can be excited successfully and has good impedance matching. The matching component group 13, which is an inductive component of 10 nH in the first embodiment, is used to compensate for the imaginary part of the upper band 22 and make the upper band 22 capable of forming a wideband operation with good impedance matching.

The antenna of the present invention can provide a lower band and an upper band with good impedance matching by using the ¼-wavelength resonant mode, the ½-wavelength resonant mode and the one-wavelength resonant mode of the radiating loop-shaped metal strip 123, and adopting proper dimensions of the coupling metal strip 122 and proper element value of the matching component group 13. The lower band 21 is ¼-wavelength resonant mode and provides an operating bandwidth of 100 MHz (890~990 MHz) covering GSM operation, and the return loss of this antenna is better than 6 dB in the lower band. The upper band 22 is formed by the ½-wavelength resonant mode and one-wavelength resonant mode and provides an operating bandwidth of 500 MHz (1700~2200 MHz) covering DCS/PCS/UMTS operation, and the return loss in the bandwidth ranging from 1710~2170 MHz is better than 6 dB. This fulfills the application demand.

Figure 3:
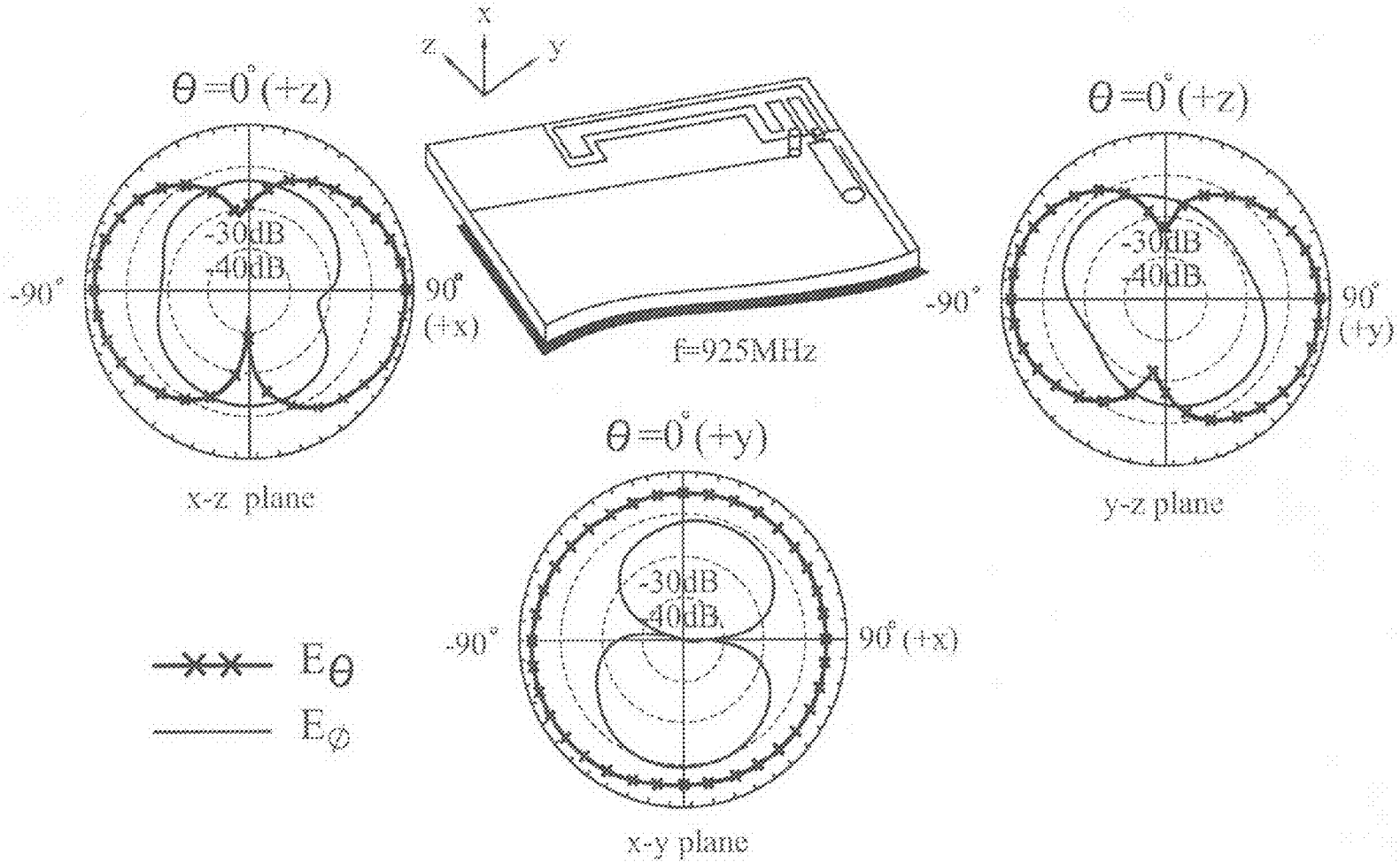
FIG. 3 is a radiation pattern at 925 MHz of the first embodiment of the antenna in the present invention.

FIG. 3 illustrates a radiation pattern of the first embodiment at 925 MHz. The obtained result indicates that the radiation pattern of the 1/-wavelength resonant mode of the radiating loop-shaped metal strip is similar to the radiation pattern of the conventional monopole antenna or conventional PIFA antenna at the same frequency.

Figure 4:
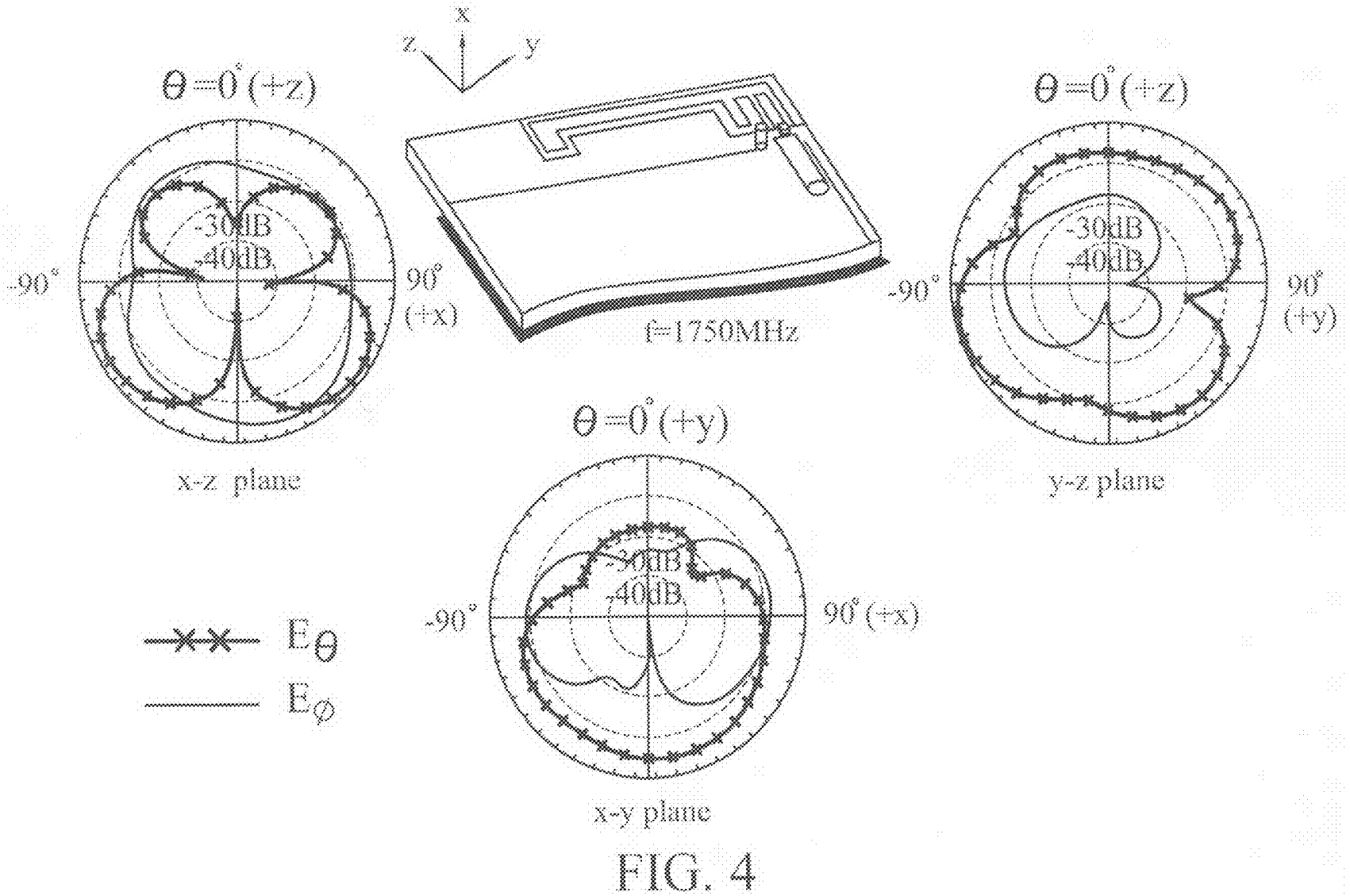
FIG. 4 is a radiation pattern at 1750 MHz of the first embodiment of the antenna in the present invention.

FIG. 4 illustrates a radiation pattern of first embodiment at 1750 MHz. The obtained result indicates that the radiation pattern of the ½-wavelength resonant mode of the radiating loop-shaped metal strip is affected by the current zero on the ground plane, so that the nulls of the radiation pattern are more than the radiation pattern at 925 MHz. The radiating pattern in the x-y plane is distorted toward the −y direction, but this does not affect the demand for actual application.

Figure 5:
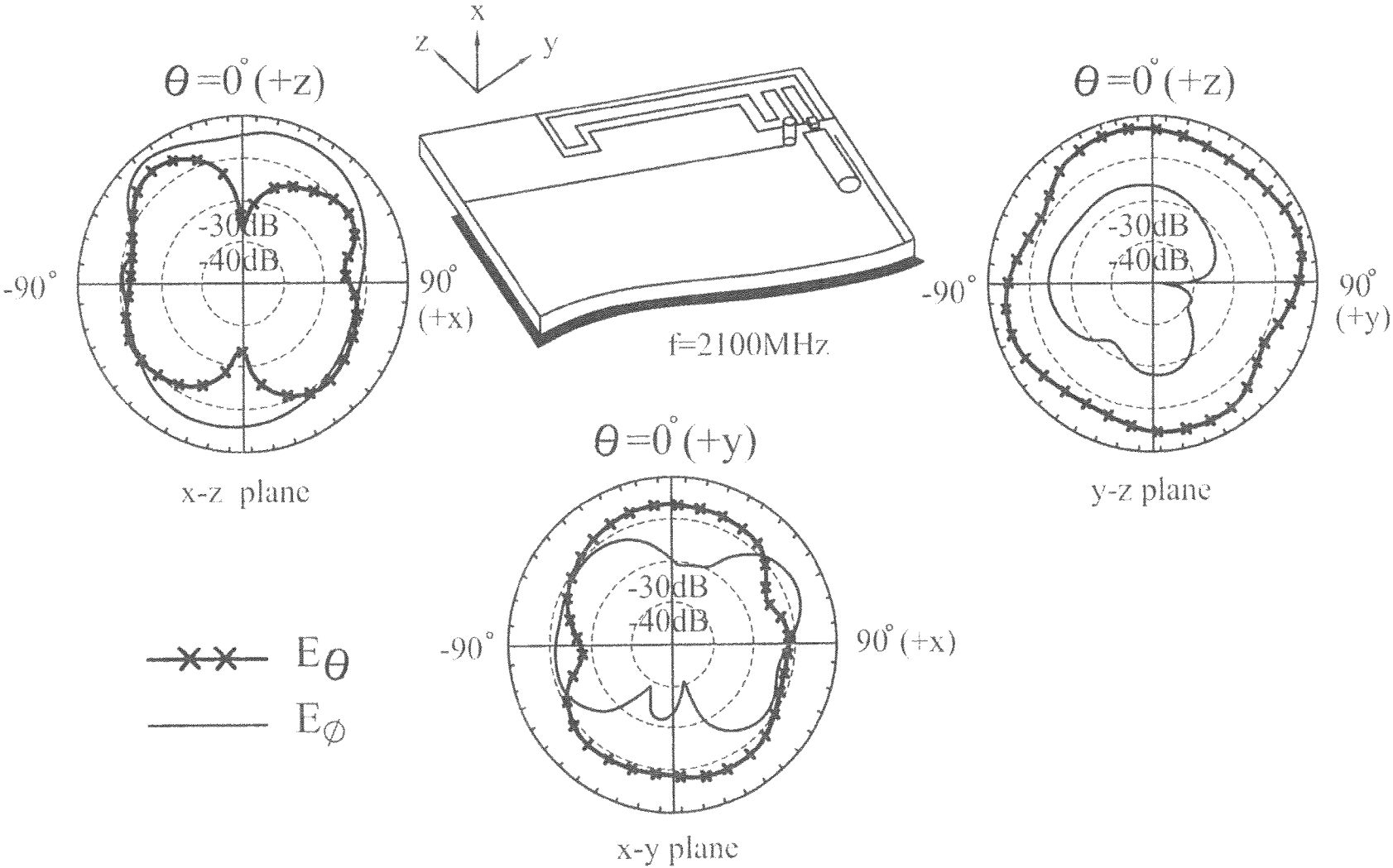
FIG. 5 is a radiation pattern at 2100 MHz of the first embodiment of the antenna in the present invention.

FIG. 5 illustrates a radiation pattern of first embodiment at 2100 MHz. The obtained result indicate that the radiation pattern at 2100 MHz is also affected by the current zero on the ground plane, like the radiation pattern at 1750 MHz in the upper band, and the nulls of the radiation pattern are more than radiation pattern at 925 MHz. Meanwhile, the portion of the radiation pattern in the ±y direction is larger than that in the ±x direction in the x-y plane. In general, this fulfills the demand for actual application.

Figure 6A:
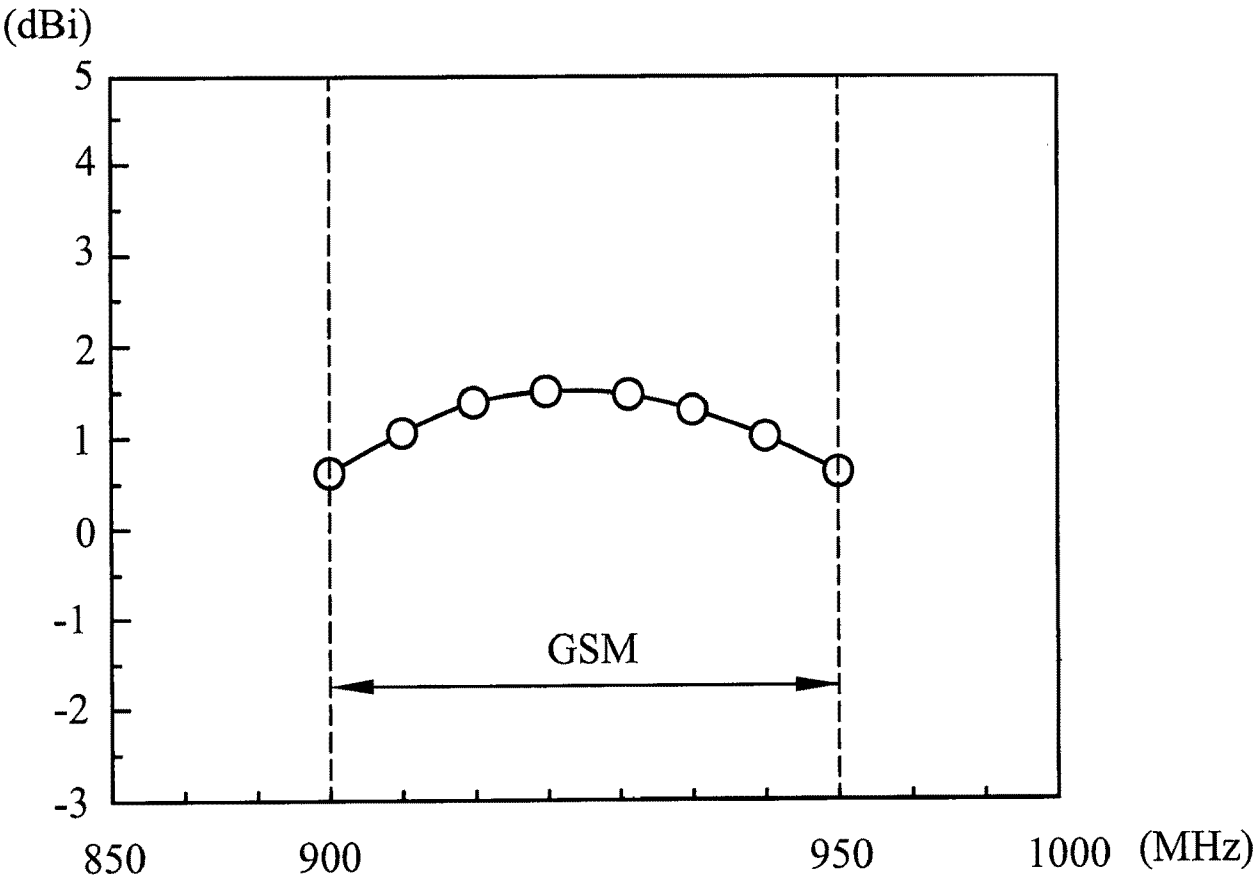
FIG. 6(*a*) is an antenna gain drawing of the first embodiment of the antenna of the present invention in the GSM band.
Figure 6B:
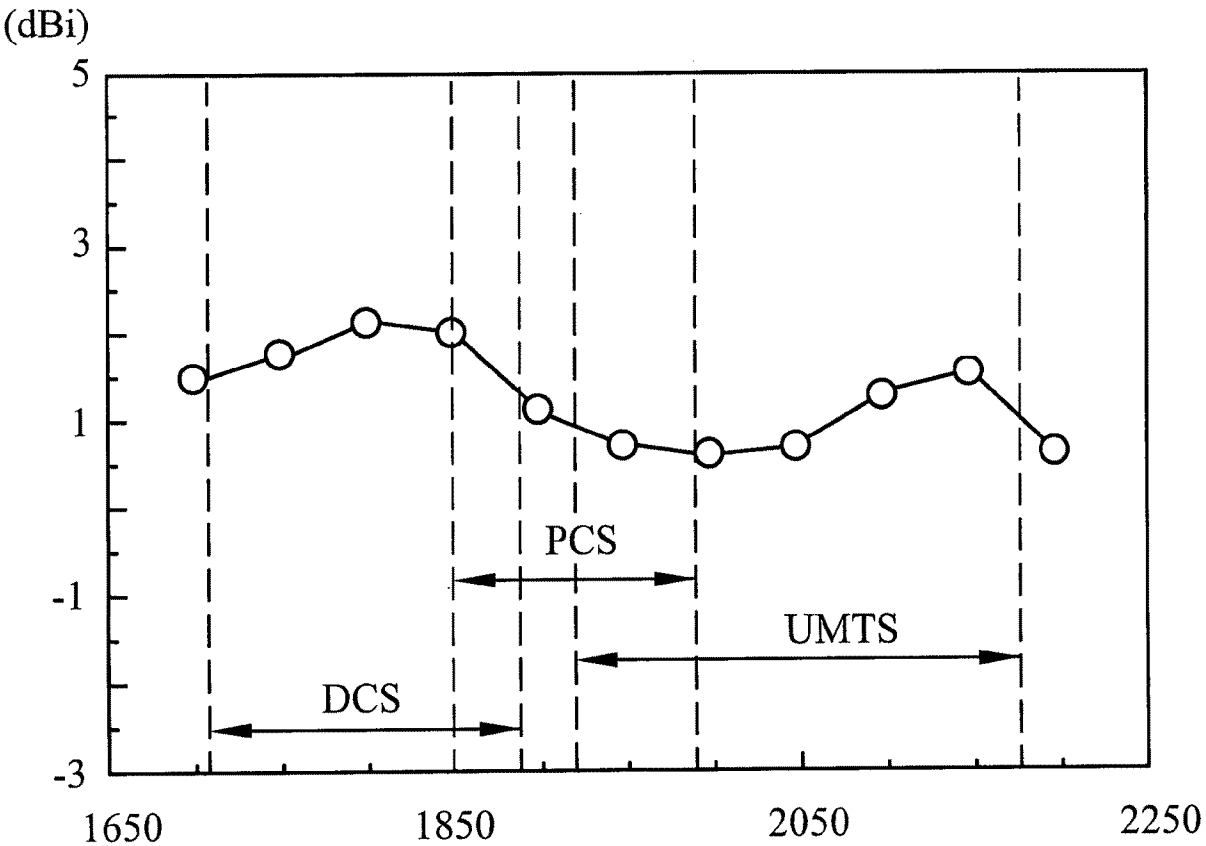

FIG. 6(*a*) and FIG. 6(*b*) illustrate antenna gain drawings of the first embodiment of the antenna of the invention for GSM operation and DCS/PCS/UMTS operation, respectively. From the measured data of first embodiment from the drawing, the antenna gain value in the GSM band is about 0.46~1.66 dBi, and the antenna gain value in the DCS/PCS/UMTS band is about 0.77~2.28 dBi. All antenna gain values fulfill the demand for actual application.

Figure 7:
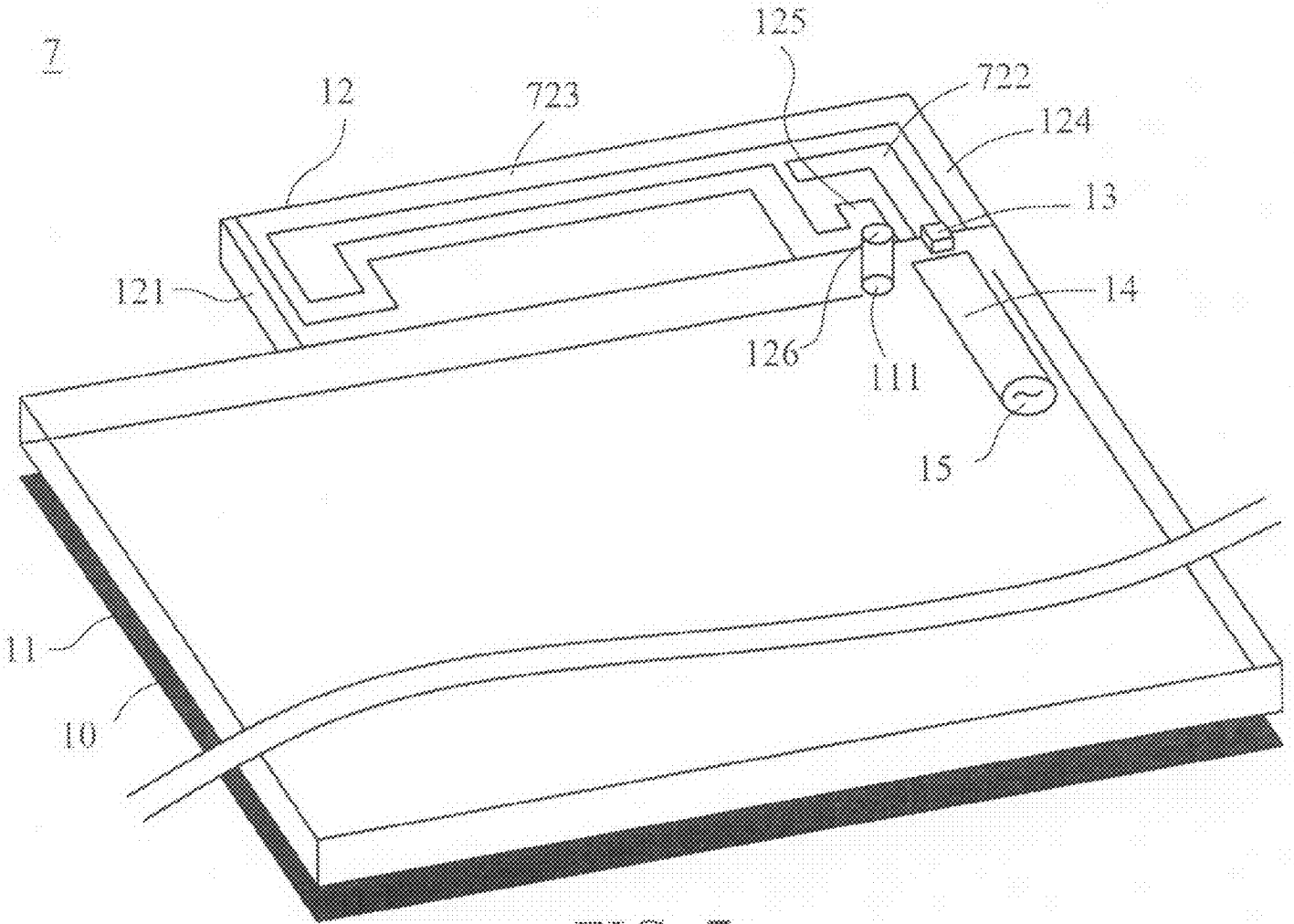
FIG. 7 is a structural drawing of the second embodiment of the antenna in the present invention.
Figure 8:
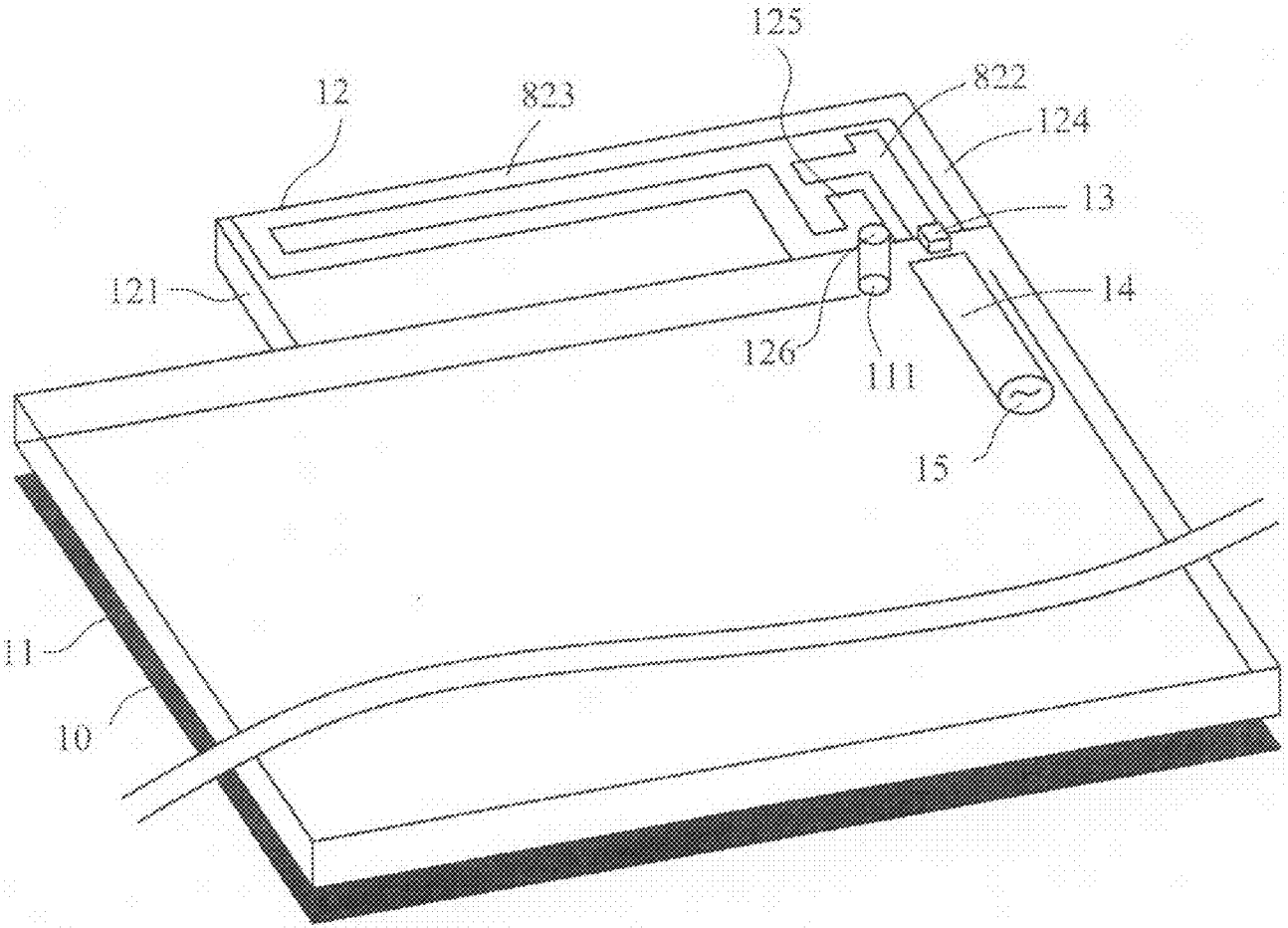
FIG. 8 is a structural drawing of the third embodiment of the antenna in the present invention.
Figure 9:
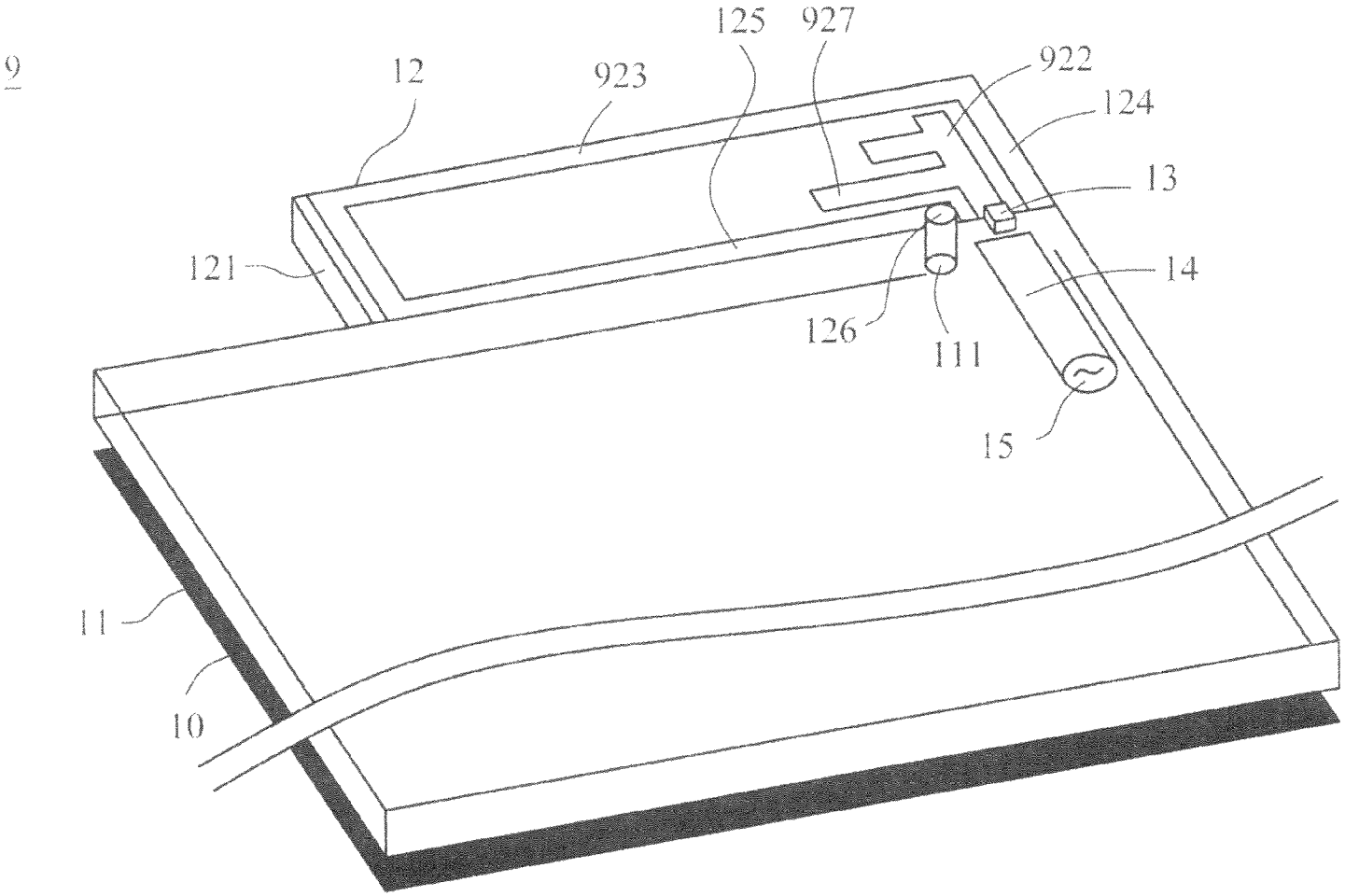
FIG. 9 is a structural drawing of the fourth embodiment of the antenna in the present invention.

FIG. 7, FIG. 8 and FIG. 9 illustrate structural drawings of the second embodiment, the third embodiment, and the fourth embodiment of the antenna of the present invention respectively. The entire structures of the second embodiment, the third embodiment and the fourth embodiment are about the same as the entire structure of first embodiment, except that the coupling metal strip of the second embodiment is L-shaped, and the coupling metal strip of the third embodiment is T-shaped, and the coupling metal strip of the fourth embodiment has two arms, and the distance between the shorting point 126 and the second end 125 of the second embodiment is slightly different from the first embodiment, and the bending manners for the radiating loop-shaped metal strips of the third embodiment and the fourth embodiment are slightly different from that of the first embodiment. However, these embodiments can achieve the same results as the first embodiment.

Concluding the abovementioned specification, the antenna of the present invention has the advantage of simple structure, clear operating mechanism, low manufacture cost and reduced antenna size for the mobile phone. Therefore, this antenna of the present invention has high industrial application value.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A coupled-fed multi-band loop antenna, comprising:

a dielectric substrate;

a ground plane located on the dielectric substrate, and having a grounding point;

a radiating portion, comprising:

a supporting substrate;

a coupling metal strip located on the supporting substrate; and a radiating loop-shaped metal strip located on a single surface of the supporting substrate wherein the length of the radiating loop-shaped metal strip is substantially ¼ wavelength of the lowest resonant frequency of the antenna, and the radiating loop-shaped metal strip has a first section, a second section, a first end portion, a second end portion and a shorting point, and the first end portion is roughly parallel with the coupling metal strip, and the shorting point is located near the second end portion and electrically connected to the grounding point of the ground plane, and an end of the second end portion is connected to the shorting point, and another end of the second end portion is a free end, and the coupling metal strip is located between the first end portion and the second end portion, and the first section is connected to the first end portion and extending perpendicular to the coupling metal strip, and the second section is parallel to the first section; and a matching component group located on the dielectric substrate, and one terminal of the matching component group electrically connected to the coupling metal strip of the radiating portion, and the other terminal of the matching component group connected to a signal source.

2. The antenna of claim 1, wherein the dielectric substrate is a system circuit board of a mobile communication device.

3. The antenna of claim 1, wherein the ground plane is a system round plane of a mobile communication device.

4. The antenna of claim 1, wherein the material of the supporting substrate is selected from the group consisting of the dielectric substrate, plastic and ceramics.

5. The antenna of claim 1, wherein the coupling metal strip is substantially straight, or L-shaped or T-shaped.

6. The antenna of claim 1, wherein the coupling metal strip has at least two arms.

7. The antenna of claim 1, wherein the matching component group is a circuit including at least one inductive component.

* * * * *

UNITED STATES PATENT AND TRADEMARK OFFICE

CERTIFICATE OF CORRECTION

PATENT NO. : 7,978,141 B2
APPLICATION NO. : 12/286254
DATED : July 12, 2011
INVENTOR(S) : Yun-Wen Chi et al.

It is certified that error appears in the above-identified patent and that said Letters Patent is hereby corrected as shown below:

Title Page, item 54 and Col. 1, line 1;

In the title of the patent, "COUPLE" should be -- COUPLED --

Signed and Sealed this
Sixth Day of September, 2011

David J. Kappos

David J. Kappos
*Director of the United States Patent and Trademark Office*